US010739711B2

(12) United States Patent
Hiate et al.

(10) Patent No.: US 10,739,711 B2
(45) Date of Patent: Aug. 11, 2020

(54) IMAGE FORMING APPARATUS AND STANDBY TEMPERATURE SETTING

(71) Applicant: Konica Minolta, Inc., Chiyoda-ku, Tokyo (JP)

(72) Inventors: Taiga Hiate, Toyokawa (JP); Takuto Shibuya, Okazaki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/375,897

(22) Filed: Apr. 5, 2019

(65) Prior Publication Data

US 2019/0317433 A1 Oct. 17, 2019

(30) Foreign Application Priority Data

Apr. 17, 2018 (JP) ..... 2018-078862

(51) Int. Cl.
*G03G 15/20* (2006.01)

(52) U.S. Cl.
CPC ..... *G03G 15/205* (2013.01); *G03G 15/2064* (2013.01)

(58) Field of Classification Search
CPC ..... G03G 15/2039; G03G 15/205; G03G 15/2064
See application file for complete search history.

(56) References Cited

U.S. PATENT DOCUMENTS

2003/0099478 A1 5/2003 Okano
2005/0191076 A1* 9/2005 Dan ..... G03G 15/205 399/70
2009/0310998 A1 12/2009 Otsuka
2011/0229228 A1* 9/2011 Yoshikawa ..... G03G 15/2039 399/329
2012/0045241 A1* 2/2012 Takahashi ..... G03G 15/2039 399/70
2013/0084094 A1 4/2013 Tamura
2016/0342115 A1* 11/2016 Takane ..... G03G 15/205

FOREIGN PATENT DOCUMENTS

JP 63-133177 6/1988
JP H02222982 A 9/1990
JP 11045030 A * 2/1999
JP 2004-101682 A 4/2004

OTHER PUBLICATIONS

Machine translation of JP 11-045030 A (publication date of Feb. 16, 1999) printed on Sep. 24, 2019.*
The partial European search report (R. 64 EPC) dated Aug. 19, 2019, by the European Patent Office in corresponding European Patent Application No. 19167001.7. (11 pages).
Extended European Search Report from the European Patent Office dated Dec. 11, 2019, for Application No. EP19167001.7-1022, 12 pages.

* cited by examiner

*Primary Examiner* — Sophia S Chen
(74) *Attorney, Agent, or Firm* — Buchanan Ingersoll & Rooney PC

(57) ABSTRACT

A fixing device of an image forming apparatus includes: a fixing belt, a heat source that heats a portion of the fixing belt; and a pressure roller that forms a nip between the pressure roller and the fixing belt and that transports a sheet. In the heat source, a standby temperature (setting temperature in a suspension standby mode) in a standby state in which rotation of the fixing belt is suspended is set to be higher than a printing temperature in a printing state.

7 Claims, 9 Drawing Sheets

FIG.6

| | ELAPSED TIME FROM START OF SUSPENSION STANDBY | | | | PRINTING TEMPERATURE (ORDINARY PAPER) |
|---|---|---|---|---|---|
| | 0～60 SECONDS | 61～120 SECONDS | 121～180 SECONDS | 181 SECONDS～ | |
| INTERNAL APPARATUS TEMPERATURE < 15℃ | 185℃ | 190℃ | 195℃ | 200℃ | 170℃ |
| 15℃ ≤ INTERNAL APPARATUS TEMPERATURE < 28℃ | 180℃ | 185℃ | 190℃ | 195℃ | 165℃ |
| 28℃ ≤ INTERNAL APPARATUS TEMPERATURE | 180℃ | 185℃ | 190℃ | 195℃ | 165℃ |

FIG.8

| SETTING TEMPERATURE FOR Temp2 | PRINTING TEMPERATURE Temp3 | | | |
|---|---|---|---|---|
| | 150°C | 155°C | 160°C | 165°C |
| V1=V2 | 150°C | 155°C | 160°C | 165°C |
| V1=1.5×V2 | 160°C | 165°C | 170°C | 175°C |
| V1=2×V2 | 165°C | 170°C | 170°C | 180°C |

IMAGE FORMING APPARATUS AND STANDBY TEMPERATURE SETTING

The entire disclosure of Japanese Patent Application No. 2018-078862, filed on Apr. 17, 2018, is incorporated herein by reference in its entirely.

BACKGROUND

Technological Field

The present invention relates to an image forming apparatus, particularly, an image forming apparatus including a fixing device.

Description of the Related Art

Conventionally, an image forming apparatus for printing an image on a sheet in accordance with an electrophotography method includes a fixing device for heating a sheet having an toner image transferred thereon (see Japanese Laid-Open Patent Publication No. 2-222982). The fixing device heats and melts the toner, which is a color material, and fixes the toner on the sheet. Hence, as a heat application source for fixing the toner to the sheet, the fixing device has a halogen lamp heater or a resistive heating type heater such as a ceramic heater, or an IH (induction heating) type heat source. After ending a warm-up operation or ending a printing operation, this fixing device is in a standby state until a new printing instruction from a user is subsequently received.

The standby state is roughly divided into the following two standby states: rotation standby in which the fixing device stands by with the fixing device being driven; and suspension standby in which the fixing device stands by with the fixing device being not driven. In the case of the rotation standby of the fixing device, while rotating a fixing belt, a pressure roller, and the like of the fixing device, the heat application source continues to heat the fixing belt and the like. In the rotation standby, a whole or the fixing device can be warmed during the standby. Hence, the temperature of the fixing device can be increased in a short period of time in response to receiving a new printing instruction. However, since the fixing belt, the pressure roller, and the like continue to rotate also during the standby in the case of the rotation standby, operating noise is generated disadvantageously.

On the other hand, in the case of the suspension standby of the fixing device, the heat application source continues to heat the fixing belt and the like with the rotation of the fixing belt, the pressure roller, and the like of the fixing device being suspended. Since the rotation of the fixing belt, the pressure roller, and the like is suspended during the standby in the case of the suspension standby, operating noise is not generated and a degree of silence is high. Due to the high degree of silence, the suspension standby has been drawing attention as a standby state of the fixing device in recent years.

However, since the rotation of the fixing belt, the pressure roller, and the like is suspended during the standby in the case of the suspension standby, the whole of the fixing device cannot be warmed and the fixing device can be heated only locally. In other words, in the case of the suspension standby, the temperature of the fixing device cannot be increased in a short period of time in response to receiving a new printing instruction unlike the rotation standby, disadvantageously.

Particularly, when the suspension standby is employed to improve a degree of silence during the standby in the configuration in which the heat application source heats the fixing device locally, heat is radiated during the standby except for the portion heated by the heat application source, with the result that the temperature is decreased. As a result, even when a new printing instruction is received, it requires time to increase the temperature of the fixing device. This leads to decrease of FPOT (First Print Output Time) or FCOT (First Copy Output Time) as compared with those in an image forming apparatus employing the rotation standby, disadvantageously.

Therefore, one object of the present technique is to provide an image forming apparatus including a fixing device, wherein even when the suspension standby is employed in a configuration in which a heat application source heats a fixing device locally, the temperature of the fixing device can be increased in a short period of time from the standby state.

SUMMARY

To achieve at least one of the above mentioned objects, according to an aspect of the present invention, an image forming apparatus reflecting one aspect of the present invention comprises: a plurality of chargers that each charge an image carrier, a plurality of developing devices that each form a toner image on the charged image carrier, and a fixing device that fixes the toner image, transferred from the image carrier to a recording medium, to the recording medium, wherein the fixing device includes a fixing rotation body, a heat application source that heats a portion of the fixing rotation body, and a pressing rotation body that forms a nip between the pressing relation body and the fixing rotation body and that transports the recording medium, and in the heat application source, a standby temperature in a standby slate in which rotation of the fixing rotation body is suspended is set to be higher than a printing temperature in a printing state.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 6 shows an exemplary temperature set in the fixing device according to the first embodiment.

FIG. 8 shows an exemplary temperature set in the fixing device according to the second embodiment.

DETAILED DESCRIPTION OF EMBODIMENTS

Figure 1:
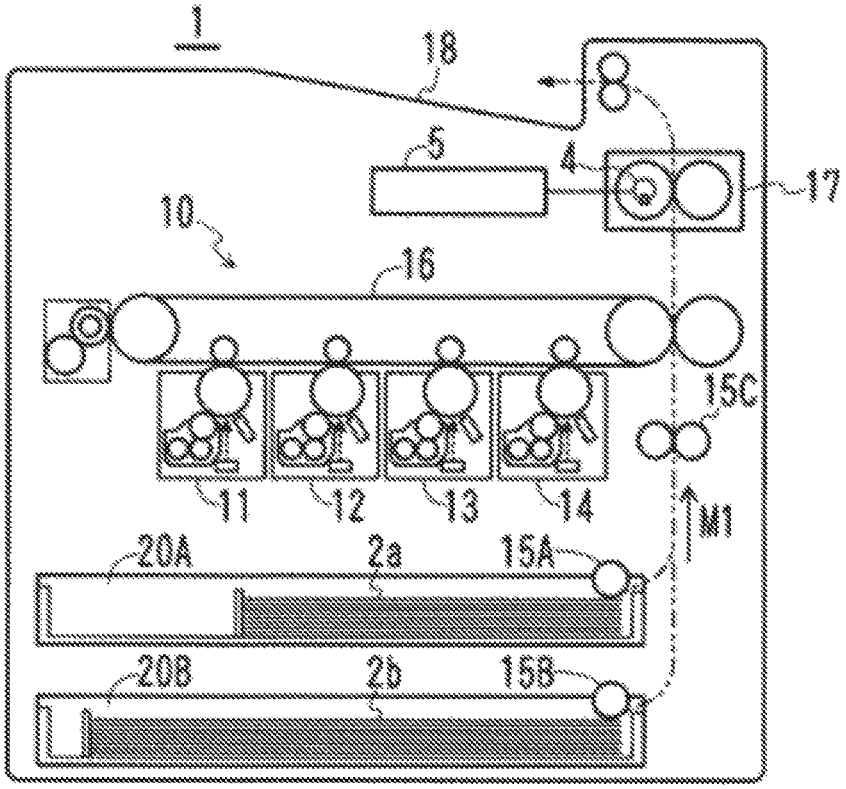
FIG. 1 shows an entire configuration of an image forming apparatus.

Hereinafter, one or more embodiments of the present invention will be described with reference to the drawings. However, the scope of the invention is not limited to the disclosed embodiments.

The following describes the present embodiment with reference to figures in detail. It should be noted that the same or corresponding portions in the figures are given the same reference characters and are not described repeatedly.

First Embodiment

FIG. 1 shows an entire configuration of an image forming apparatus 1. For example, image forming apparatus 1 is a copying machine, a printer, a facsimile, or a multi-functional peripheral including functions thereof, and prints an image onto a printing medium M1 (for example, a sheet of paper) in the form of a sheet. In FIG. 1, image forming apparatus 1 is a color printer including: an electrophotographic type printer engine 10; and a plurality of sheet cassettes 20A, 20B. Printer engine 10 is mainly constituted of four imaging stations 11, 12, 13, 14. Sheet cassettes 20A, 20B can store different sizes of sheets 2*a*, 2*b*, pick up sheets 2*a*, 2*b* using pickup rollers 15A, 15B, and supply the sheets to printer engine 10.

In the first embodiment, sheet 2*a* is of A4 size and sheet 2*b* is of A3 size. Sheets 2*a*, 2*b* picked up by pickup rollers 15A, 15B are transported to printer engine 10 in a transportation direction M1. In printer engine 10, four imaging stations 11 to 14 form four-color toner images of Y (yellow), M (magenta), C (cyan), and K (black) in parallel in a color printing mode.

Each of imaging stations 11 to 14 includes: a photoconductor (image carrier) having a tubular shape; a charger; a developing device; a cleaner; a light source for exposure; and the like. Each of the toner images formed by imaging stations 11 to 14 is primarily transferred from the photoconductor to an intermediate transfer belt 16 and is carried thereon. The toner image having been primarily transferred is secondarily transferred to a sheet (for example, sheet 2*a*) serving as a recording medium and transported from a selected one (for example, sheet cassette 20A) of sheet cassettes 20A, 20B via a resist roller 15C. After the secondary transfer, the sheet is sent to an ejection tray 18 at an upper portion through the inside of a fixing device 17. When passing through fixing device 17, the toner image is fixed to the sheet due to application of heat and pressure.

Fixing device 17 at least has a heat application member for applying heat and a pressure roller for applying pressure when fixing the toner image to the sheet. Moreover, the heat application member has a heat application source 4 (for example, a halogen heater or the like) for applying heat locally, and can uniformly apply heat by driving fixing device 17. It should be noted that the temperature of heat application source 4 is controlled by a controller 5. However, when the driving of fixing device 17 is suspended during a standby state (suspension standby), a temperature difference occurs between a portion near heat application source 4 and a portion away from heat application source 4. There are various types of structures for fixing device 17. In the description below, a fixing device having a representative structure will be illustrated to explain a temperature change during the suspension standby.

Figure 2:
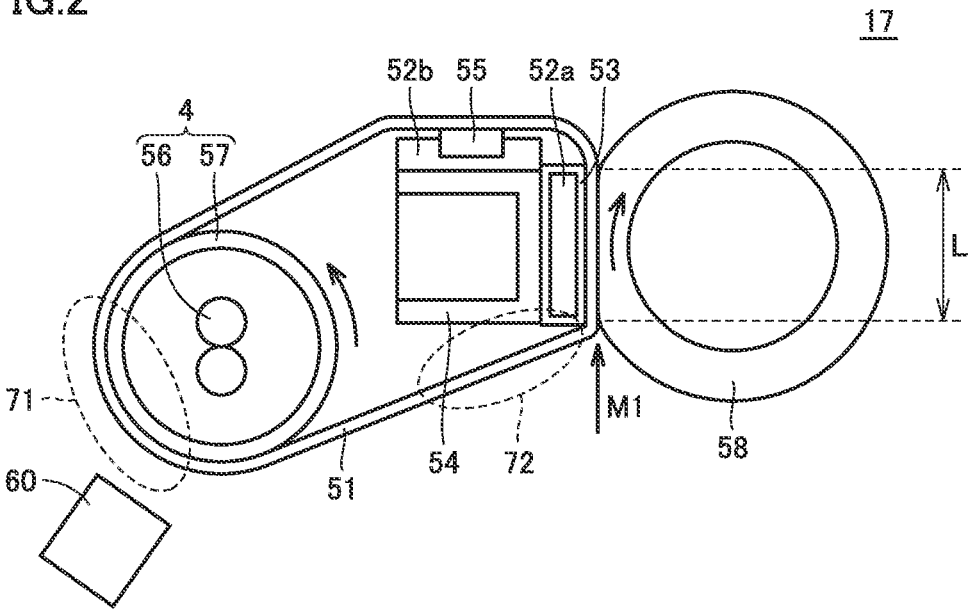
FIG. 2 shows an exemplary configuration of a fixing device in the image forming apparatus.

FIG. 2 shows an exemplary configuration of fixing device 17 in image forming apparatus 1. Fixing device 17 is a fixing device for locally applying heat. Fixing device 17 shown in FIG. 2 employs a halogen heater as the heat application source. For example, the configuration for locally applying heat to fixing device 17 is a configuration having a heat application member 57 that can heat a portion of fixing belt 51, wherein a whole of fixing device 17 is heated by driving fixing belt 51. Specifically, fixing device 17 includes: fixing belt 51 (fixing rotation body); a pressure roller 58; a fixed pressure application member 52 (52*a*, 52*b*) disposed at the inner side relative to fixing belt 51 to press pressure roller 58 to form a nip and guide the rotation of fixing belt 51; a slide member 53 disposed between fixing belt 51 and pressure application member 52 (52*a*); a supporting member 54 that supports pressure application member 52; a felt member 55; and heat application member 57 having a heat source 56, fixing belt 51 being tensioned and laid on heat application member 57 and pressure application member 52.

Pressure roller 58 can be rotated at a predetermined rotating speed by a fixing motor (not shown). Accordingly, fixing belt 51 can be rotated with respect to pressure roller 58. Fixing belt 51 is constituted of a three-layer structure including a base layer, an elastic layer, and a releasing layer. The outer diameter of fixing belt 51 is appropriately determined, but is desirably about 10 mm to 100 mm. The base layer is composed of polyimide, stainless steel (for example, SUS304 or the like), electroformed Ni, or the like, and has a thickness of about 5 μm to 100 μm. For the elastic layer, a material having a high heat resistance is desirable, such as a silicone rubber or a fluororubber. The thickness of the elastic layer is about 10 μm to 100 μm. The releasing layer is desirably a configuration with releasability, such as a fluorine tube or a fluorine-based coating. The thickness of the releasing layer is about 5 μm to 100 μm.

Pressure application member 52 is composed of: a resin, such as polyphenylene sulfide, polyimide, or a liquid crystal polymer; a metal, such as aluminum or iron; a ceramic; or the like. The shape of pressure application member 52 is appropriately determined. Pressure application member 52 may have a two-component configuration including: a portion for applying pressure; and a fixation portion constituted of a silicone rubber, a fluororubber, or the like.

Slide member 53 employs a glass cloth as a base member and is generally configured to have a slide surface coated with a fluorine-based resin; however, a fluorine fiber fabric, a fluororesin sheet, a glass coat, or the like may be used therefor. By providing slide member 53, slide resistance between fixing belt 51 and pressure application member 52 is decreased, whereby fixing belt 51 can be rotated stably.

Heat application member 57 is constituted of a metal cylinder such as aluminum or stainless steel (for example SUS304 or the like). The outer diameter of heat application member 57 is appropriately determined but is desirably 10 mm to 100 mm. The thickness of heat application member 57 is desirably about 0.1 mm to 5 mm. When a halogen heater is employed as heat source 56, heat application member 57 desirably has a black-colored inner surface. Moreover, in order to prevent damage on the outer surface of heat application member 57 by a foreign matter or the like, a PTFE (polytetrafluoroethylene) coating or the like may be provided to the outer surface of heat application member 57. It should be noted that heat source 56 and heat application member 57 correspond to heat application source 4 that heats fixing belt 51.

Pressure roller 58 is constituted of the following three members: a core, an elastic layer, and a releasing layer. The outer diameter of pressure roller 58 is appropriately determined, but is desirably about 20 mm to 100 mm. For the elastic layer, a material having a high heat resistance is desirable, such as a silicone rubber or a fluororubber. The thickness of the elastic layer is about 1 mm to 20 mm. The core is desirably a metal such as aluminum or iron, may have a pipe shape with a thickness of about 0.1 mm to 10 mm, may be solid, or may have an odd shape with a cross section in the form of three arrows. The releasing layer is desirably a configuration with releasability, such as a fluorine tube or a fluorine-based coating. The thickness of the releasing layer is about 5 μm to 100 μm.

A halogen heater is employed for heat source 56, and electric power to be supplied thereto is controlled such that a temperature detected by a temperature sensor 60 becomes equal to a temperature set in advance. Here, it is assumed that a portion of fixing belt 51 around heat source 56 represents a heated portion 71, and a portion of fixing belt 51 away from heat source 56 represents a non-heated portion 72. It should be noted that the temperature of heated portion 71 is detected by temperature sensor 60, whereas the temperature of non-heated portion 72 is detected by a temperature sensor provided separately.

In fixing device 17 shown in FIG. 2, pressure application member 52 presses fixing belt 51 against pressure roller 58 to form a fixing nip portion L. It should be noted that although not shown in the figure, a sensor for detecting a transported sheet is provided in the vicinity of fixing nip portion L. The sheet transported to fixing device 17 passes through fixing nip portion L in transportation direction M1 in such a state that the surface of the sheet having the toner image transferred thereon faces heated fixing belt 51, whereby the sheet is heated and pressed by fixing belt 51. Accordingly, the toner image is fixed to the sheet.

Figure 3:
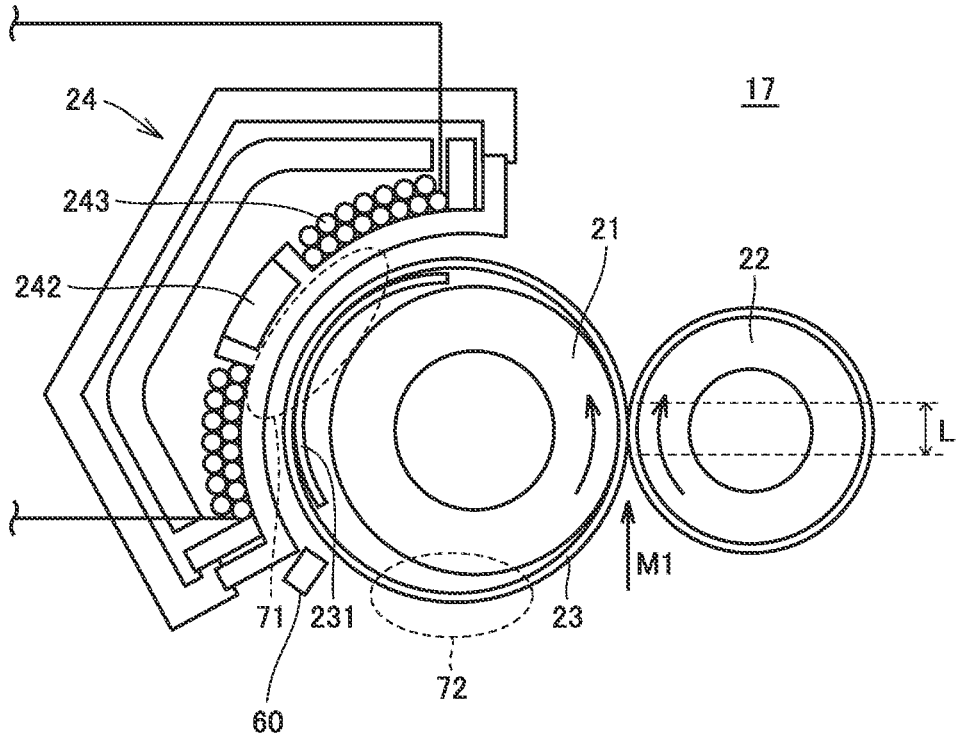
FIG. 3 shows another exemplary configuration of the fixing device in the image forming apparatus.

Next, FIG. 3 shows another exemplary configuration of fixing device 17 in image forming apparatus 1. Fixing device 17 shown in FIG. 3 employs IH (induction heating) for heat application source 4. Fixing device 17 shown in FIG. 3 is of induction heating type, and includes a magnetic flux generator 24 for heating a tubular, flexible fixing belt 23. Fixing belt 23 is rotated together with a fixing roller 21 with fixing belt 23 being supported by fixing roller 21 and a guide plate 231. Magnetic flux generator 24 includes: a bobbin 242 along a circumferential surface affixing belt 23; and an exciting coil 243 supported by bobbin 242. Exciting coil 243 is supplied with electric power for excitation from an IH power supply connected to an AC input portion (not shown).

In fixing device 17 shown in FIG. 3, fixing roller 21 disposed at the inner side relative to fixing belt 23 and pressure roller 22 disposed at the outer side relative to fixing belt 23 form fixing nip portion L with fixing belt 23 being interposed therebetween. Fixing roller 21 is driven by a fixing motor (not shown) to rotate at a predetermined circumferential speed in transportation direction M1 in which the sheet is transported. Since fixing roller 21 is driven to rotate, fixing belt 23 and pressure roller 22 are rotated according to the rotation of fixing roller 21 due to frictional force with fixing roller 21.

The IH power supply increases or decreases the electric power to be supplied to exciting coil 243 of magnetic flux generator 24, in accordance with an instruction from controller 5 of image forming apparatus 1. When fixing belt 23 is heated, each of the temperatures of fixing roller 21 and pressure roller 22 is increased due to heat conduction from fixing belt 23. That is, fixing roller 21 and pressure roller 22 are indirectly heated by magnetic flux generator 24.

For heat application source 4, the IH including magnetic flux generator 24 is employed, and electric power to be supplied to magnetic flux generator 24 is controlled such that a temperature detected by temperature sensor 60 becomes equal to a temperature set in advance. Here, it is assumed that a portion of fixing belt 23 around magnetic flux generator 24 represents a heated portion 71, and a portion of fixing belt 23 away from magnetic flux generator 24 represents a non-heated portion 72.

The sheet transported to fixing device 17 shown in FIG. 3 passes through fixing nip portion L in transportation direction M1 in such a state that the surface of the sheet having the toner image transferred thereon faces heated fixing belt 23, whereby the sheet is heated and pressed by fixing belt 23. Accordingly, the toner image is fixed to the sheet.

Figure 4:
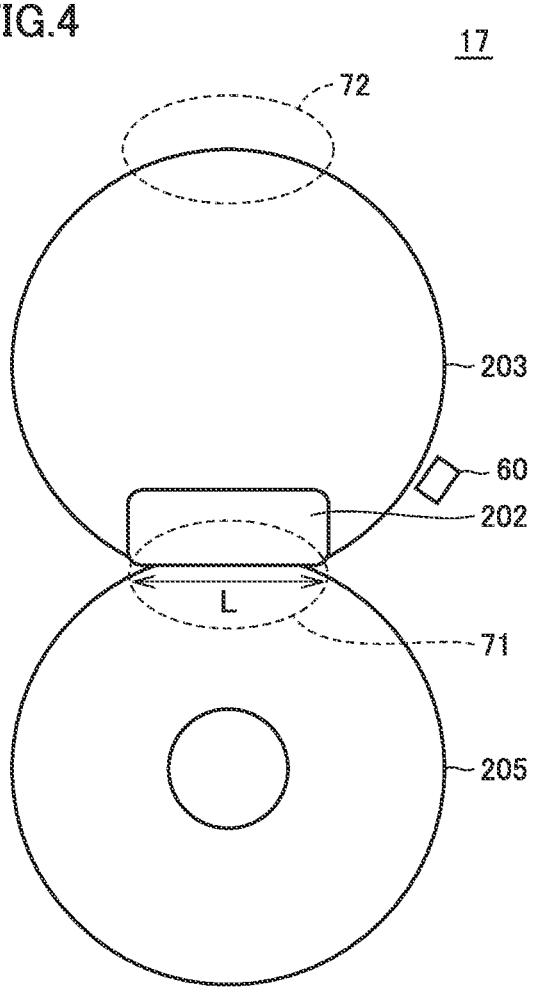
FIG. 4 shows still another exemplary configuration of the fixing device in the image forming apparatus.

Next, FIG. 4 shows still another exemplary configuration of fixing device 17 in image forming apparatus 1. Fixing device 17 shown in FIG. 4 employs resistive heating for heat application source 4. Fixing device 17 has a heater 202 that generates heat using electric power supplied from a power supply (not shown). Specifically, heater 202 is a ceramic heater. Heater 202 is fixed by a heater holder (not shown), and the heater holder serves as an inner surface guide for a fixing belt 203.

Pressure roller 205 is disposed to be pressed against heater 202 with fixing belt 203 being interposed therebetween. A portion at which heater 202 and pressure roller 205 are pressed against each other with fixing belt 203 being interposed therebetween is fixing nip portion L. Pressure roller 205 is driven by a fixing motor (not shown) to rotate at a predetermined circumferential speed. Due to frictional force between pressure roller 205 and the outer circumference of fixing belt 203 at fixing nip portion L, the rotation force of pressure roller 205 directly acts on fixing belt 203, whereby fixing belt 203 is driven to rotate with fixing belt 203 being pressed against and sliding on the lower surface of heater 202.

When the rotation of fixing belt 203 according to the rotation of pressure roller 205 becomes stable and the temperature of heater 202 is increased to a predetermined temperature, a sheet on which a toner image is to be fixed is transported to fixing nip portion L. The sheet transported to fixing device 17 passes through fixing nip portion L in transportation direction M1 in such a state that the surface of the sheet having the toner image transferred thereon faces heated fixing belt 203, whereby the sheet is heated and pressed by fixing belt 203. Accordingly, the toner image is fixed to the sheet.

Heater 202 for resistive heating is employed for heat application source 4, and electric power to be supplied to heater 202 is controlled such that a temperature detected by a temperature sensor 60 becomes equal to a temperature set in advance. Here, it is assumed that a portion of fixing belt 203 around heater 202 represents a heated portion 71, and a portion of fixing belt 203 away from heater 202 represents a non-heated portion 72.

Figure 5A:
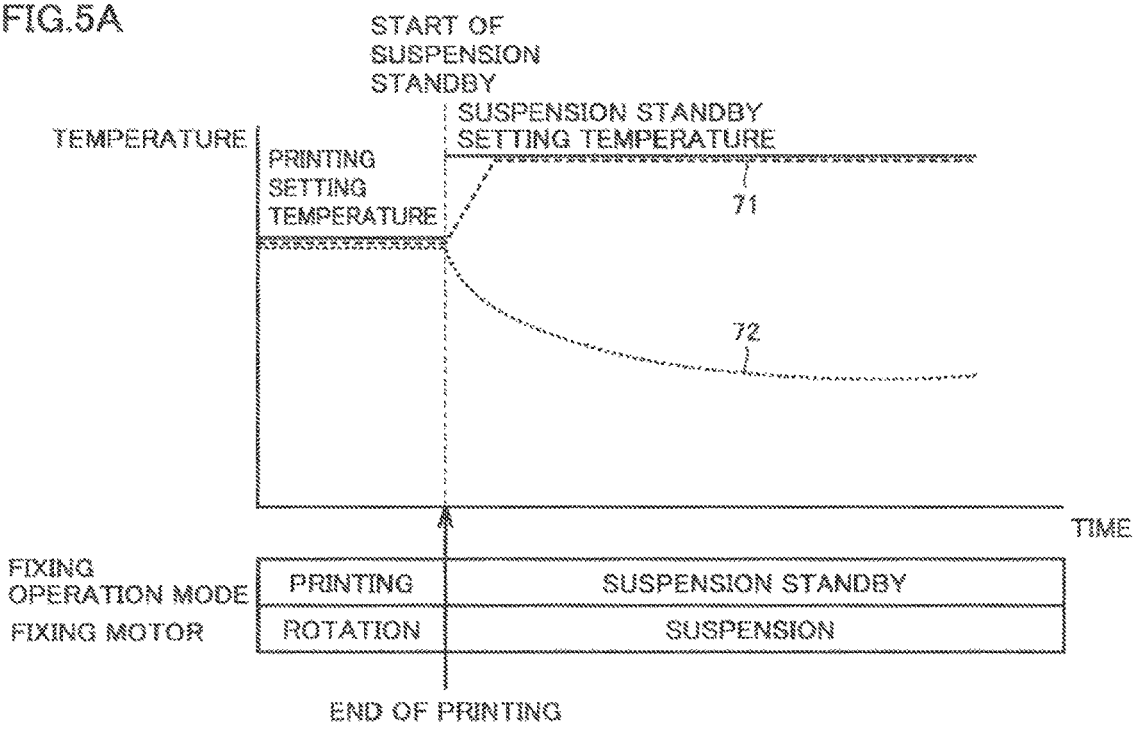
FIG. 5A is a diagram for illustrating a temperature change in the fixing device according to a first embodiment.
Figure 5B:
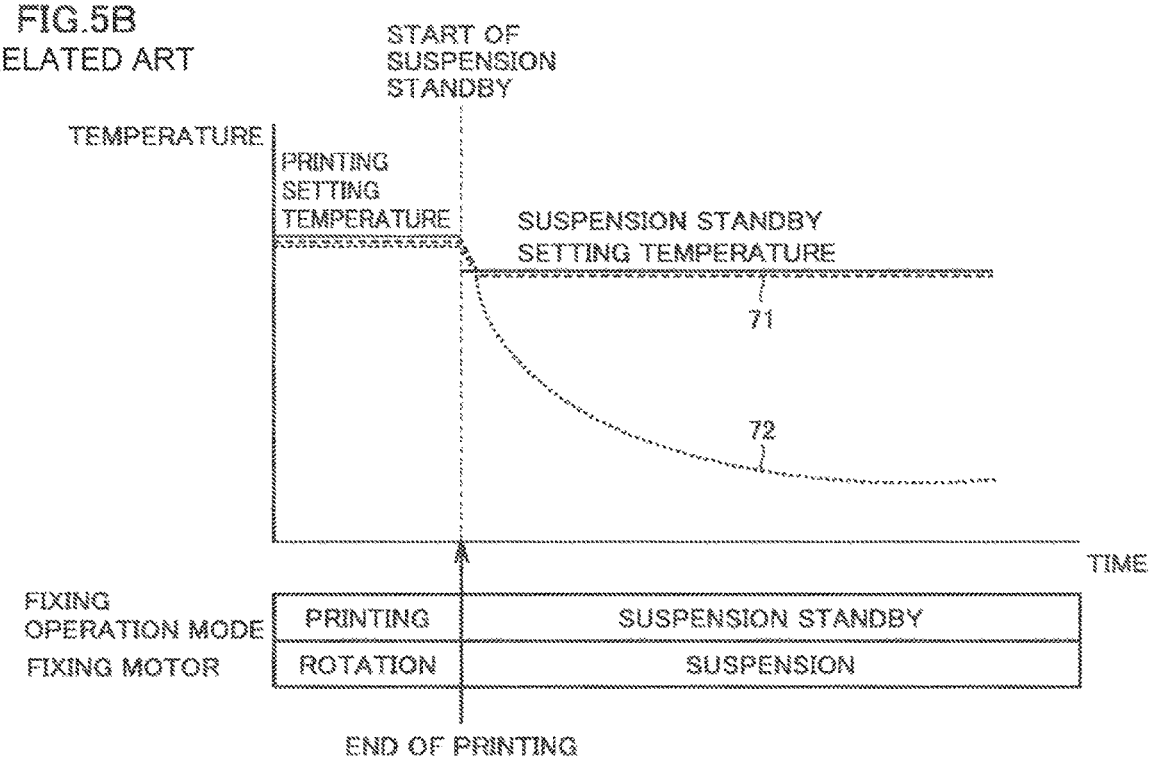
FIG.5B RELATED ART
FIG. 5B is a diagram for illustrating the temperature change in the fixing device.

Next, the following describes temperature changes at heated portion 71 and non-heated portion 72 during the suspension standby in each of fixing devices 17 shown in FIG. 2 to FIG. 4. Each of FIG. 5A and FIG. 5B is a diagram for illustrating a temperature change in fixing device 17. Each of FIG. 5A and FIG. 5B shows the temperature change with respect to time when the operation mode of fixing device 17 is transitioned from the printing mode to the suspension standby mode. Hence, in the graph shown in each of FIG. 5A and FIG. 5B, the horizontal axis represents the time and the vertical axis represents the temperature. When the operation mode is the printing mode, electric power is supplied to the heat source in fixing device 17 such that the temperature detected by temperature sensor 60 becomes equal to a printing temperature set in advance.

In fixing device 17 according to the first embodiment, when the operation mode is transitioned from the printing mode to the suspension standby mode, the setting temperature in the suspension standby mode is made higher than the printing temperature as shown in FIG. 3A. It should be noted that solid lines in the graph shown in FIG. 5A respectively indicate setting temperatures in the printing mode and the suspension standby mode. The temperature of heated portion 71 of fixing belt 51 around the heat source is indicated by a broken line, and the temperature of non-heated portion 72 of fixing belt 51 away from heat source 56 is indicated by a dotted line. Moreover, since fixing device 17 employs the suspension standby for the standby state, the operation of the fixing motor is suspended during the standby.

In fixing device 17 according to the first embodiment, by setting the setting temperature in the suspension standby mode to be higher than the printing temperature, the temperature of the fixing belt at non-heated portion 72 away from the heat source can be maintained to be high due to the following two effects.

The first effect is heat transfer in the circumferential direction of fixing belt 51. By setting the setting temperature in the suspension standby mode to be high, the temperature of heated portion 71 also becomes high. Accordingly, a large amount of heat is transferred also to the portion of fixing belt 51 away from the heat source, whereby the temperature of non-heated portion 72 can also be maintained to be high.

The second effect is suppression of an amount of heat radiation from non-heated portion 72 away from the heat source by setting the internal temperature of fixing device 17 to be high. By setting the setting temperature in the suspension standby mode to be high, the internal temperature of fixing device 17 becomes higher than that in the printing mode. Accordingly, the amount of heat radiation to an atmospheric air from non-heated portion 72 away from the heat source is reduced, with the result that the temperature of non-heated portion 72 can be maintained to be high.

Meanwhile, FIG. 5B shows a comparative example in which when the operation mode is transitioned from the printing mode to the suspension standby mode, the setting temperature in the suspension standby mode is set to be slightly lower than the printing temperature, rather than setting the setting temperature in the suspension standby mode to be higher than the printing temperature as in the first embodiment. When the temperature control as in the first embodiment is not performed, the temperature of heated portion 71 is maintained at the setting temperature during both the printing and the standby because heated portion 71 is close to the heat source, but the temperature of non-heated portion 72 is decreased due to heat radiation during the standby because the operation of the fixing motor is suspended and non-heated portion 72 therefore cannot be in contact with the heated fixing belt.

In the comparative example of FIG. 5B, the setting temperature in the suspension standby mode is equal to or less than that during the printing, so that the temperature of non-heated portion 72 during the suspension standby is greatly decreased. Accordingly, when increasing the temperature of the fixing belt to the printing temperature in response to receiving a printing instruction during the suspension standby, the temperature of the fixing belt other than that in the vicinity of heated portion 71 needs to be increased from the low temperature, with the result that it takes time to increase the temperature of the fixing belt. Hence, when the temperature control as in the comparative example of FIG. 5B is performed, FPOT (First Print Output Time) and FCOT (First Copy Output Time) are decreased, disadvantageously.

However, by setting the setting temperature in the suspension standby mode to be higher than the printing temperature (FIG. 5A) as in the first embodiment when the operation mode is transitioned from the printing mode to the suspension standby mode, the decrease of the temperature of non-heated portion 72 away from the heat source during the suspension standby can be reduced. Therefore, in image forming apparatus 1 according to the first embodiment, when increasing the temperature of the fixing belt to the printing temperature in response to receiving a printing instruction during the standby, a period of time for increasing the temperature of fixing belt 51 can be shortened because the decrease of the temperature of non-heated portion 72 during the suspension standby is reduced. Accordingly, FPOT and FCOT can be improved.

It should be noted that the fixing belt is employed in each of fixing devices 17 shown in FIG. 2 to FIG. 5A and FIG. 5B; however, a drum configuration may be employed instead of the fixing belt. Also in fixing device 17 employing the drum configuration, the same effect can be obtained by setting the setting temperature in the suspension standby mode to be higher than the printing temperature as described above.

As described above, an image forming apparatus 1 according to the first embodiment includes: a plurality of chargers that each charge a photoconductor; a plurality of developing devices that each form a toner image on the charged photoconductor; and a fixing device 17 that fixes the toner image, transferred from the photoconductor to a sheet, to the sheet. Fixing device 17 includes: a fixing belt 51 (23, 203); a heat source 56 (magnetic flux generator 24, heater 202) that heats a portion of fixing belt 51 (23, 203); and a pressure roller 58 (22, 202) that forms a nip between pressure roller 58 (22, 202) and fixing belt 51 (23, 203) and that transports the sheet. In heat source 56 (magnetic flux generator 24, heater 202), a standby temperature in a standby state in which rotation of fixing belt 51 (23, 203) is suspended (setting temperature in the suspension standby mode) is set to be higher than a printing temperature in a printing state. Accordingly, in image forming apparatus 1 according to the first embodiment, even when the suspension standby is employed for the configuration in which heat source 56 (magnetic flux generator 24, heater 202) locally heats fixing device 17, the temperature at the portion other than the heated portion is suppressed from being decreased, whereby the temperature of filing device 17 can be increased from the standby state in a short period of time.

The setting temperatures during the printing and the standby are not fixed, and may be set to be changed in accordance with an environment. Examples of the environment include: the internal temperature of image forming apparatus 1 (apparatus temperature), an elapsed time from the start of the standby state; an external temperature; the temperature of the sheet; and the like. It should be noted that image forming apparatus 1 is provided with a temperature sensor (temperature detector) (not shown) to detect the internal temperature of image forming apparatus 1. The following specifically describes a case where the apparatus temperature and the elapsed time from the start of the standby state are employed as the environment and the setting temperature is changed in accordance with the apparatus temperature and the elapsed time from the start of the standby state.

FIG. 6 shows an exemplary temperature set in the fixing device according to the first embodiment. A table shown in FIG. 6 shows the setting temperature in the suspension standby mode, which is set in accordance with the apparatus temperature and the elapsed time from the start of the suspension standby. For example, when the apparatus temperature is less than 15° C., the setting temperature in the suspension standby mode is set to 185° C. if the elapsed time from the start of the suspension standby is 0 to 60 seconds, and the setting temperature in the suspension standby mode is set to 200° C. if the elapsed time from the start of the suspension standby is more than or equal to 181 seconds. That is, since an amount of heat radiated from non-heated portion 72 to the atmospheric air is increased as the elapsed time from the start of the suspension standby becomes longer, the setting temperature in the suspension standby mode is set to be high.

Meanwhile, when the elapsed time from the start of the suspension standby is 0 to 60 seconds, the setting temperature in the suspension standby mode is set to 185° C. if the apparatus temperature is less than 15° C., and the setting temperature in the suspension standby mode is set to 180° C. if the apparatus temperature is less than or equal to 28° C. That is, as the apparatus temperature becomes lower, an amount of heat radiated from non-heated portion 72 to the atmospheric air is increased, so that the setting temperature in the suspension standby mode is set to be high. It should be noted that the printing temperature (the setting temperature in the printing mode) is also changed in accordance with the apparatus temperature. For example, the printing temperature is set to 170° C. if the apparatus temperature is less than 15° C., and the printing temperature is set to 165° C. if the apparatus temperature is less than or equal to 28° C. That is, since an amount of heat radiated from non-heated portion 72 to the atmospheric air is increased as the apparatus temperature becomes lower, the printing temperature is also set to be high.

The standby temperature (the setting temperature in the suspension standby mode) may be set to be changed in accordance with the environment. For example, the standby temperature may be set to be changed in accordance with the period of time from the start of the standby state, or may be set to be higher as the internal temperature of image forming apparatus 1 detected by the temperature sensor for detecting the internal temperature becomes lower. By setting the standby temperature in accordance with the environment in this way, the standby temperature can set to a temperature according to the environment, thereby reducing a state in which an unnecessarily high setting temperature is employed. Accordingly, power consumption can be suppressed. Moreover, the standby temperature may be set to be higher as the period of time from the start of the standby state (the elapsed time from the start of the suspension standby) becomes longer.

Regarding image forming apparatus 1 according to the first embodiment, it has been described that the setting temperature in the suspension standby mode is set to be higher than the printing temperature in the color printer having the plurality of imaging stations 11, 12, 13, 14; however, image forming apparatus 1 according to the first embodiment can be also applied in the same manner to a monochrome printer having a single imaging station. It should be noted that in the color printer having the plurality of imaging stations 11, 12, 13, 14, the toner image needs to be fixed to the sheet at a temperature higher than that in the monochrome printer having a single imaging station. Hence, the setting of the setting temperature in the suspension standby mode to be higher than the printing temperature is effective to improve FPOT and FCOT.

Second Embodiment

Figure 7:
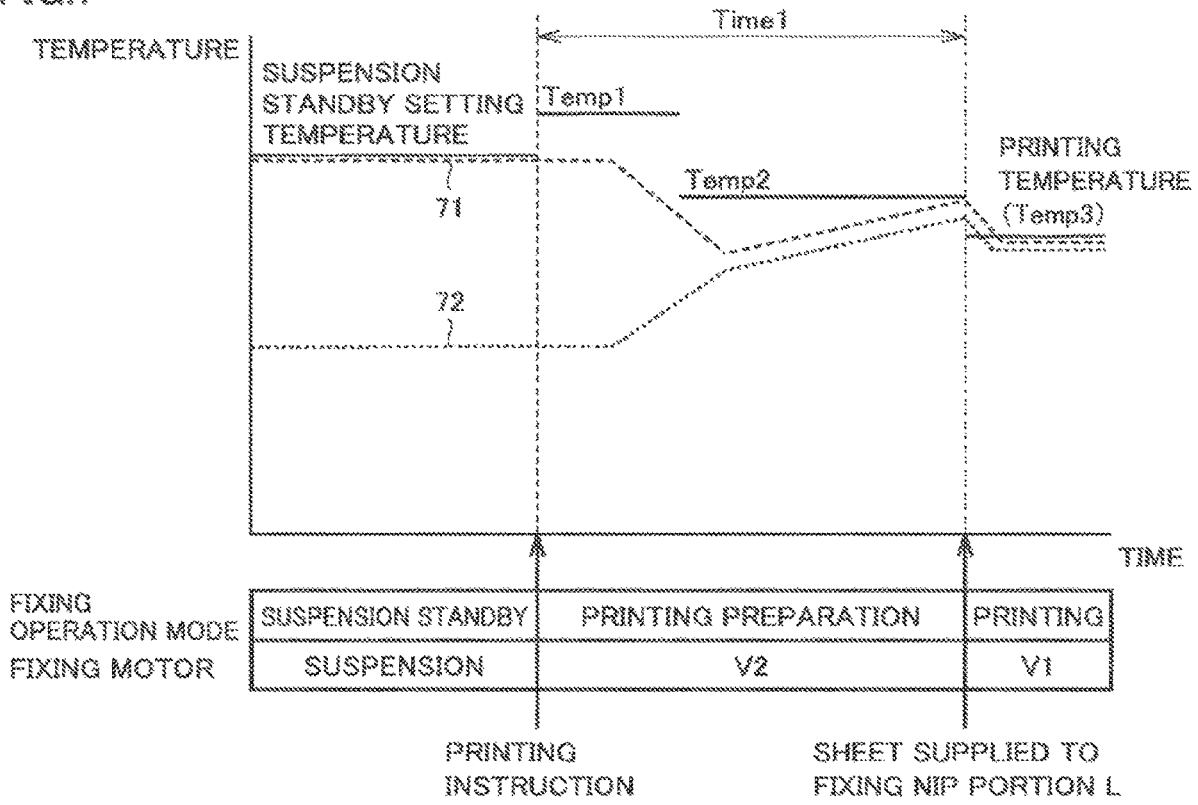
FIG. 7 is a diagram for illustrating temperature control in a fixing device according to a second embodiment.

Next, in an image forming apparatus 1 according to a second embodiment, temperature control for increasing the temperature of fixing device 17 is performed in response to receiving a printing instruction while the temperature control in the suspension standby mode as described in the first embodiment is performed. FIG. 7 is a diagram for illustrating the temperature control in fixing device 17 according to the second embodiment. FIG. 7 shows a temperature change with respect to time when increasing the temperature of fixing device 17 in response to receiving a printing instruction during the suspension standby. Hence, in the graph shown in FIG. 7, the horizontal axis represents the time and the vertical axis represents the temperature. It should be noted that since the configurations of image forming apparatus 1 and fixing device 17 according to the second embodiment are the same as the configurations of image forming apparatuses 1 and fixing devices 17 shown in FIG. 1 to FIG. 4, the same reference characters are given to the same configurations and detailed description thereof will not be repeated. Hereinafter, the configuration of fixing device 17 will be described with reference to the configuration of fixing device 17 shown in FIG. 2, and the same applies to the configurations of other fixing devices 17.

In fixing device 17 according to the second embodiment, a setting temperature during printing preparation is made higher than the setting temperature in the suspension standby mode when the operation mode is transitioned from the suspension standby mode to the printing mode as shown in FIG. 7. It should be noted that solid lines in the graph shown in FIG. 7 respectively represent the setting temperatures of the suspension standby mode, the printing preparation mode, and the printing mode. A broken line represents the temperature of heated portion 71 of fixing belt 51 near the heat source, and a dotted line represents the temperature of non-heated portion 72 of fixing belt 51 away from heat source 56. Moreover, since fixing device 17 employs the suspension standby for the standby state, the operation of the fixing motor is suspended during the standby.

In fixing device 17, when the operation mode is the suspension standby mode, the heat source is supplied with electric power such that the temperature detected by temperature sensor 60 becomes equal to the setting temperature in the suspension standby mode set in advance. When heat source 56 is operated with the driving of the fixing motor being suspended in fixing device 17 employing the configuration for locally applying heat, a temperature difference occurs between heated portion 71 around heat source 56 and non-heated portion 72 away from heat source 56, thus resulting in a temperature distribution in the circumferential direction of fixing belt 51. When a sheet enters fixing nip portion L while there is such a temperature distribution in fixing belt 51, uneven gloss occurs according to the temperature distribution. To address this, when a printing instruction is received during the suspension standby, transition is made to the printing preparation mode for a preparation period after starting the printing state in response to receiving the printing instruction, in order to increase the temperature of fixing device 17. In the printing preparation mode, the decreased temperature of non-heated portion 72 of fixing belt 51 needs to be increased to eliminate the temperature distribution promptly.

In order to increase the temperature of fixing belt 51 at non-heated portion 72 having the temperature decreased due to heat radiation dining the suspension standby, heat source 56 needs to be always on during the printing preparation mode. For example, during the printing preparation mode, such an on state can be attained in the following manner: full electric power is applied to heat source 56 by setting, to 100%, a duty ratio of electric power to be supplied to heat source 56. It should be noted that the setting of the duty ratio of the electric power to be supplied to 100% is stored in a setting table for operating heat source 56 in the printing preparation mode.

However, whether to turn on or off heat source 56 is determined by the temperature of fixing belt 51 at heated portion 71. Therefore, by setting a setting temperature Temp1 in the printing preparation mode to be higher than the setting temperature in the suspension standby mode, heat source 56 can be in the on state just after the start of the printing preparation mode. Setting temperature Temp1 is set to be changed in accordance with the setting temperature in the suspension standby mode. For example, when the setting temperature in the suspension standby mode is 180° C., setting temperature Temp1 is set to 190° C., whereas when the setting temperature in the suspension standby mode is 190° C., setting temperature Temp1 is set to 200° C.

Even when heat source 56 is brought into the on state, there is a time lag until the temperature of fixing belt 51 is actually increased. Hence, the temperature of fixing belt 51 is unchanged for few seconds. Here, the time lag includes: a period of time until electric power is started to be supplied to heat source 56 after instructing to supply electric power to bring heat source 56 into the on state; a period of time until heat source 56 is warmed up after starting to supply electric power to heat source 56; a through-up time when through-up control is employed in order to prevent inrush current to heat source 56; and the like.

Since fixing belt 51 is driven in the printing preparation mode, the portion of fixing belt 51 heated by heat source 56 and having a high temperature is moved to a position in contact with pressure roller 58 and heat is transferred to pressure roller 58 therefrom, with the result that the temperature of the portion is decreased. However, this portion of fixing belt 51 is moved to the position in contact with heat source 56 again, and therefore comes into contact with and is heated by heat source 56 that is in the on state. Here, in the printing preparation mode, the temperature of fixing belt 51 may be increased faster in the following manner: by setting the rotating speed of the fixing motor to a speed V2 slower than a speed V1 in the printing mode, the number of times of making contact between fixing belt 51 and pressure roller 58 per unit time can be reduced, whereby the heat of fixing belt 51 having the increased temperature is less likely to be transferred to pressure roller 58.

Moreover, as shown in FIG. 7, the setting temperature in the printing preparation mode may be set to setting temperature Temp1 higher than the setting temperature in the suspension standby mode, and then may be changed to a setting temperature Temp2 after passage of a predetermined period of time. Since setting temperature Temp1 is a temperature higher than the setting temperature in the suspension standby mode, a problem may occur if setting temperature Temp1 is set for a long period of time. Moreover, when fixing belt 51 is driven, the temperature of fixing belt 51 in the vicinity (heated portion 71) of temperature sensor 60 is decreased as compared with that when fixing belt 51 is unmoved as shown in FIG. 7. Hence, heat source 56 can be on even when the setting temperature is not as high as setting temperature Temp1. Therefore, setting temperature Temp2 may be a temperature that allows heat source 56 to be on. For example, setting temperature Temp2 is set to be lower than setting temperature Temp1 and the setting temperature in the suspension standby mode and to be higher than the setting temperature (printing temperature Temp3) in the printing mode. Because heat source 56 is on due to setting temperature Temp2 being set, the respective temperatures of heated portion 71 and non-heated portion 72 of fixing belt 51 can be increased as shown in FIG. 7.

It should be noted that setting temperature Temp2 is set to be higher than printing temperature Temp3 in the printing mode due to the following reason: when a transition is made from the printing preparation mode to the printing mode, the rotating speed of the fixing motor is switched from speed V2 to faster speed V1, so that the number of times of making contact between fixing belt 51 and pressure roller 58 per unit time is increased to facilitate transfer of heat of heated fixing belt 51 to pressure roller 58, thus resulting in a decreased temperature of fixing belt 51. In other words, setting temperature Temp2 in the printing preparation mode is set to be higher than printing temperature Temp3 in advance by a temperature to be decreased when a transition is made from the printing preparation mode to the printing mode.

Thus, setting temperature Temp2 in the printing preparation mode is determined by the rotating speed of the fixing motor and printing temperature Temp3 in the printing mode. Hence, the following describes how setting temperature Temp2 in the printing preparation mode is changed in accordance with the rotating speed of the fixing motor and printing temperature Temp3 in the printing mode. FIG. 8 shows an exemplary temperature set in fixing device 17 according to the second embodiment. A table shown in FIG. 8 shows setting temperature Temp2 set in accordance with the rotating speed of the fixing motor and printing temperature Temp3. For example, when the rotating speed, V1, of the fixing motor in the printing mode is the same as the rotating speed, V2, of the fixing motor in the printing preparation mode (V1=V2), setting temperature Temp2 is 150° C. if printing temperature Temp3 is 150° C., and setting temperature Temp2 is 165° C. if printing temperature Temp3 is 165° C. That is, when the rotating speed of the fixing motor in the printing mode and the rotating speed of the fixing motor in the printing preparation mode are the same, setting temperature Temp2 is set to the same temperature as printing temperature Temp3.

Meanwhile, when the rotating speed, V1, of the fixing motor in the printing mode is set to be 1.5 times as large as the rotating speed, V2, of the fixing motor in the printing preparation mode (V1=1.5×V2), setting temperature Temp2 is 160° C. if printing temperature Temp3 is 150° C., and setting temperature Temp2 is 175° C. if printing temperature Temp3 is 165° C. In other words, when the rotating speed of the fixing motor in the printing mode is set to be 1.5 times as large as the rotating speed of the fixing motor in the printing preparation mode, setting temperature Temp2 is set to a temperature obtained by adding 10° C. to printing temperature Temp3. Further, when the rotating speed, V1, of the fixing motor in the printing mode is set to be twice as large as the rotating speed, V2, of the fixing motor in the printing preparation mode (V1=2×V2), setting temperature Temp2 is 165° C. if printing temperature Temp3 is 150° C., and setting temperature Temp2 is 180° C. if printing temperature Temp3 is 165° C. In other words, when the rotating speed of the fixing motor in the printing mode is set to be twice as large as the rotating speed of the fixing motor in the printing preparation mode, setting temperature Temp2 is set to a temperature obtained by adding 15° C. to printing temperature Temp3.

In FIG. 8, setting temperature Temp2 is set to be higher as the rotating speed, V1, of the fixing motor in the printing mode is faster than the rotating speed, V2, of the fixing motor in the printing preparation mode and as printing temperature Temp3 is higher. It should be noted that in FIG. 8, explanation is made based on the speed ratio of speed V1 and speed V2; however, the setting of setting temperature Temp2 to be higher as speed V1 is faster than speed V2 may be made based on a speed difference between speed V1 and speed V2. Moreover, setting temperature Temp1 may be set to be higher as the rotating speed, V1, of the fixing motor in the printing mode is faster than the rotating speed, V2, of the fixing motor in the printing preparation mode.

Figure 9:
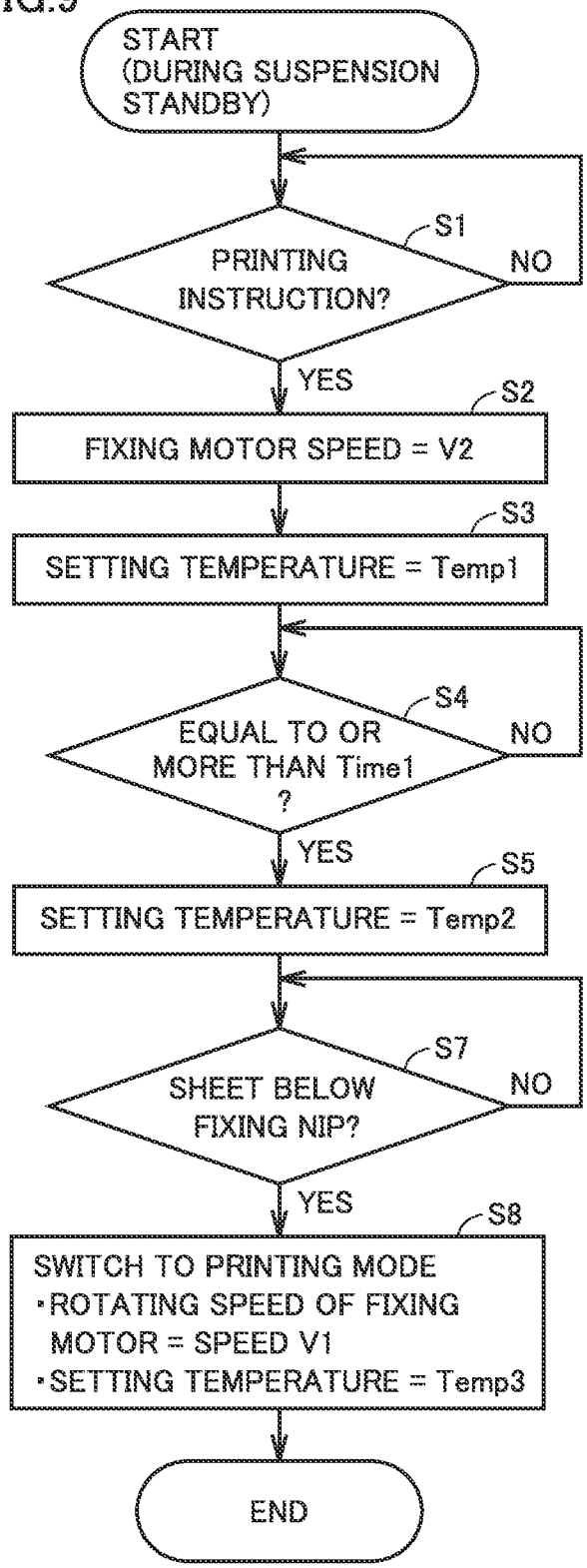
FIG. 9 is a flowchart for illustrating control of the fixing device in the image forming apparatus according to the second embodiment.

Next, the following describes control for returning from the suspension standby to the printing mode in image forming apparatus 1 according to the second embodiment with reference to a flowchart. FIG. 9 is a flowchart for illustrating control of fixing device 17 in image forming apparatus 1 according to the second embodiment. First, controller 5 of image forming apparatus 1 determines whether or not a new printing instruction is received (step S1). When no printing instruction is received (NO in step S1), controller 5 returns the process to step S1 to continue the operation in the suspension standby mode. When a printing instruction is received (YES in step S1), controller 5 starts to drive the fixing motor at rotating speed V2, which is the speed in the printing preparation mode (step S2).

Next, controller 5 sets the setting temperature of heat source 56 to setting temperature Temp1 in the printing preparation mode (step S3). By setting the setting temperature of heat source 56 to setting temperature Temp1 so as to bring heat source 56 into the on state, the temperature of the portion of fixing belt 51 having a decreased temperature due to the portion being away from heat application member 57 is increased.

Next, controller 5 determines whether an elapsed time from the start of the printing preparation mode is more than or equal to Time1 (for example, a few seconds) (step S4). When the elapsed time is less than Time1 (NO in step S4), controller 5 returns the process to step S4 to continuously employ setting temperature Temp1 for the setting temperature of heat source 56. When the elapsed time is more than or equal to Time1 (YES in step S4), controller 5 sets the setting temperature of heat source 56 to setting temperature Temp2 in the printing preparation mode (step S5). Since the temperature of the portion of fixing belt 51 above temperature sensor 60 is decreased due to fixing belt 51 being driven and heat source 56 is on even when setting temperature Temp2 is set, the setting temperature is changed to setting temperature Temp2 lower than setting temperature Temp1. It should be noted that heat source 56 is maintained to be on even when the setting temperature is changed to setting temperature Temp2.

Next, controller 5 determines whether or not the recording medium (sheet) is positioned below fixing nip portion L (step S7). When the recording medium has not yet arrived at below fixing nip portion L (NO in step S7), controller 5 returns the process to step S7 to continuously employ setting temperature Temp2 for the setting temperature of heat source 56. When the recording medium has arrived at below fixing nip portion L (YES in step S7), controller 5 ends the printing preparation mode and switches to the printing mode (step S8). Specifically, controller 5 drives to rotate the fixing motor at speed V1 in the printing mode, sets the setting temperature of heat source 56 to printing temperature Temp3 in the printing mode, and allows the recording medium to pass through fixing nip portion L.

As described above, in fixing device 17 according to the second embodiment, heat source 56 is always on during a preparation period (printing preparation mode) after starting the printing state in response to receiving a printing instruction. For example, in fixing device 17, the duty ratio of electric power to be supplied to heat source 56 is set to 100% during the preparation period. Accordingly, the temperature of fixing belt 51 at non-heated portion 72 having a temperature decreased due to heat radiation during the suspension standby can be increased promptly.

Moreover, in fixing device 17, a setting temperature (setting temperature Temp1) of heat source 56 may be set to be higher than the standby temperature (setting temperature in the suspension standby mode), the setting temperature being set after starting the printing state in response to receiving a printing instruction. Accordingly, heat source 56 can be in the on state just after starting the printing preparation mode.

Setting temperature Temp1 may be set to be changed in accordance with printing temperature Temp3 as shown in FIG. 8. Moreover, in fixing device 17, the fixing motor may be set to rotate at a speed V1 (first speed) in the printing state (printing mode) and rotate at a speed V2 (second speed) during the preparation period (printing preparation mode), and speed V2 may be set to be less than or equal to speed V1. In fixing device 17, a setting temperature Temp2 of heat source 56 may be set to be changed in accordance with a speed ratio of speed V1 and speed V2 as shown in FIG. 8, setting temperature Temp2 being set after starting the printing state in response to receiving the printing instruction. It should be noted that setting temperature Temp2 of heat source 56 may be set to be changed in accordance with a speed difference between speed V1 and speed V2. Accordingly, the number of times of making contact between fixing belt 51 and pressure roller 58 per unit time can be reduced, whereby the temperature of fixing belt 51 can be increased more promptly.

The preparation period (printing preparation mode) may be a period of time from start of transportation of the recording medium to arrival of the recording medium at a nip portion L. Moreover, the setting temperature (setting temperature Temp1, Temp2) may be changed multiple times in accordance with a period of time from start of transportation of the recording medium to arrival of the recording medium at a nip portion L as shown in FIG. 7. Accordingly, setting temperature Temp1 higher than the setting temperature in the suspension standby mode can be avoided from being set for a long period of time.

Regarding image forming apparatus 1 according to the second embodiment, it has been described that setting temperature Temp1 of heat source 56 set after starting the printing state in response to receiving the printing instruction is set to be higher than the setting temperature in the suspension standby mode in the color printer having the plurality of imaging stations 11, 12, 13, 14; however, image forming apparatus 1 according to the second embodiment can be also applied in the same manner to a monochrome printer having a single imaging station. It should be noted that in the color printer having the plurality of imaging stations 11, 12, 13, 14, the toner image needs to be fixed to the sheet at a temperature higher than that in the monochrome printer having a single imaging station. Hence, the setting of setting temperature Temp1 to be higher than the setting temperature in the suspension standby mode is effective to improve FPOT and FCOT.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

a plurality of chargers that each charge an image carrier;

a plurality of developing devices that each form a toner image on a charged image carrier; and a fixing device that fixes each toner image, transferred from the image carrier to a recording medium, to the recording medium, wherein the fixing device includes a fixing rotation body, a heat application source that heats a portion of the fixing rotation body, and a pressing rotation body that forms a nip between the pressing rotation body and the fixing rotation body and that transports the recording medium, and in the heat application source, a standby temperature in a standby state in which rotation of the fixing rotation body is suspended is set to be higher than a printing temperature in a printing state, wherein in the fixing device, a setting temperature of the heat application source is set to be higher than the standby temperature, the setting temperature being set after starting the printing state in response to receiving a printing instruction.

2. The image forming apparatus according to claim 1, wherein the setting temperature is set to be changed in accordance with the printing temperature.

3. The image forming apparatus according to claim 1, wherein the setting temperature is changed multiple times in accordance with a period of time from start of transportation of the recording medium to arrival of the recording medium at a nip portion of the fixing rotation body.

4. An image forming apparatus comprising:

a plurality of chargers that each charge an image carrier;

a plurality of developing devices that each form a toner image on a charged image carrier; and a fixing device that fixes each toner image, transferred from the image carrier to a recording medium, to the recording medium, wherein the fixing device includes a fixing rotation body, a heat application source that heats a portion of the fixing rotation body, and a pressing rotation body that forms a nip between the pressing rotation body and the fixing rotation body and that transports the recording medium, and in the heat application source, a standby temperature in a standby state in which rotation of the fixing rotation body is suspended is set to be higher than a printing temperature in a printing state, wherein in the fixing device, the heat application source is always on during a preparation period after starting the printing state in response to receiving a printing instruction, and wherein in the fixing device, a duty ratio of electric power to be supplied to the heat application source is set to 100%, during the preparation period.

5. The image forming apparatus according to claim 4, wherein in the fixing device, the fixing rotation body is set to rotate at a first speed in the printing state and rotate at a second speed during the preparation period, and the second speed is set to be less than or equal to the first speed.

6. The image forming apparatus according to claim 5, wherein in the fixing device, a setting temperature of the heat application source is set to be changed in accordance with a speed ratio of the first speed and the second speed, the setting temperature being set after starting the printing state in response to receiving the printing instruction.

7. The image forming apparatus according to claim 4, wherein the preparation period is a period of time from start of transportation of the recording medium to arrival of the recording medium at a nip portion of the fixing rotation body.

* * * * *